US005424737A

United States Patent [19]

Lindell

[11] Patent Number: 5,424,737

[45] Date of Patent: Jun. 13, 1995

[54] COMMUNICATIONS RETRO-REFLECTOR

[75] Inventor: Kevin W. Lindell, Trumbull, Conn.

[73] Assignee: United Technologies Corporation, Hartford, Conn.

[21] Appl. No.: 171,308

[22] Filed: Dec. 22, 1993

[51] Int. Cl.[6] ..... H01Q 15/00

[52] U.S. Cl. ..... 342/5; 342/6

[58] Field of Search ..... 342/5, 6, 11, 45

[56] References Cited

U.S. PATENT DOCUMENTS

| | | | |
|---|---|---|---|
| 3,206,749 | 9/1965 | Chatelain | 342/11 |
| 3,295,132 | 12/1966 | Chapman, Jr. | 342/11 |
| 3,295,137 | 12/1966 | Fenwick et al. . | |
| 3,566,128 | 2/1971 | Arnaud . | |
| 3,703,723 | 11/1972 | Albanese et al. | 342/11 |
| 3,896,440 | 7/1975 | Wheeler . | |
| 4,031,535 | 6/1977 | Isbister | 342/11 |
| 4,090,198 | 5/1978 | Canty et al. . | |
| 4,288,337 | 9/1981 | Ota et al. . | |
| 4,314,249 | 2/1982 | Onoe . | |
| 4,370,654 | 1/1983 | Krutsch . | |
| 4,419,669 | 12/1983 | Slager et al. . | |
| 4,568,944 | 2/1986 | Cassel . | |
| 4,647,930 | 5/1987 | Carof et al. . | |
| 4,723,123 | 2/1988 | Marlow et al. . | |
| 4,806,932 | 2/1989 | Bechtel . | |
| 4,987,418 | 1/1991 | Kosowsky et al. . | |

OTHER PUBLICATIONS

"Model C Spherical Dielectric Radar Target", *Technical Bulletin 510,* Cuming Corporation, 230 Bodwell Street, Avon Mass. 02322.

"Model L Luneberg Lens Microwave Device", *Technical Bulletin 530,* Cuming Corporation, 230 Bodwell Street, Avon Mass. 02322.

"Luneberg and Einstein Lenses", Sec. 14–10, *Antennas,* J. Kraus, McGraw-Hill Book Company, Second Ed. pp. 688–690.

"Using Conducting Plastics", T. Kuan et al, *Aerospace Composite Materials* 1 (3) : 31–34 Spring 1989.

"Signature Reduction Key to A–10 Survival", D. Fulghum, *Aviation Week & Space Technology,* Jun. 7, 1993, pp. 135–137.

*Introduction to Radar Systems,* M. Skolnik, McGraw-Hill Book Company, Inc. 1962, First Ed. 1962, pp. 293–294. (Also Second Ed., pp. 252–254, pub. 1980.

Joseph C. Anselmo, Washington/Aviation Week Group, "'Smark Highway'Business Attracts Aerospace Firms", Aviation Week & Space Technology/Jan. 31, 1994, pp. 56–57.

*Primary Examiner*—Mark Hellner

[57] ABSTRACT

A lens such as a Luneberg lens is used in a retro-reflector having a plurality of reflector elements formed in a mosaic covering a predetermined portion of the lens. Each of the reflector elements may be individually controlled independently of the others; in this way, an interrogation source whose direction can be determined can have its interrogation signals reflected back only to it by having only one or a selected few of the reflector elements act as reflectors. Reflection in other directions may be suppressed by causing the other mosaic elements to act as absorbers. In addition, the reflectors can have their reflective or transmissive properties modulated so as to act as amplitude or phase modulators of the interrogation signal. In this way, information can be imparted to the reflected interrogation signal. Doppler effects, on account of the velocity of a vehicle upon which the retro-reflector is mounted, are corrected for each of the individual reflector elements depending upon their positions on the Luneberg lens in relation to the vehicle and its direction of motion and velocity. The lens can be arranged with fixed elements in a pattern with symmetry about an axis of rotation of the lens; such elements need not be fixed, however, and may also be individually controlled or controlled as a group in a pattern.

34 Claims, 9 Drawing Sheets

FIG. 1
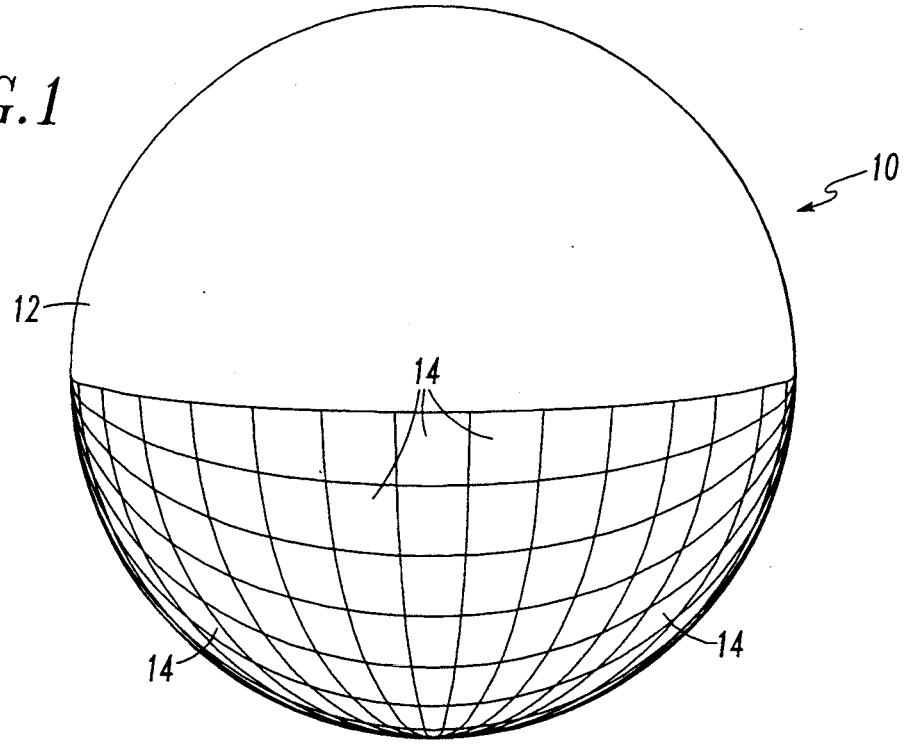
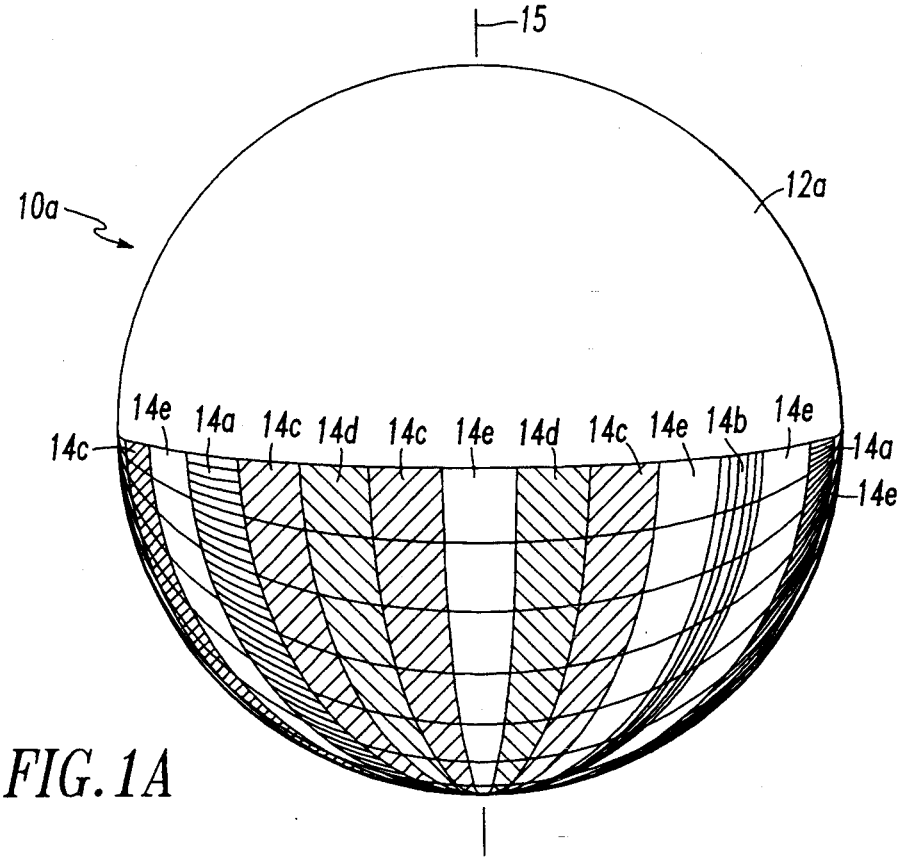
FIG. 1A

FIG. 1B
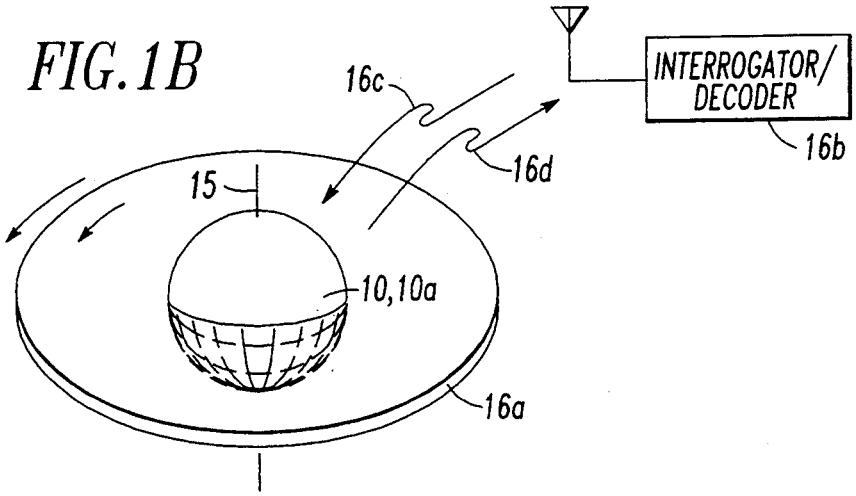
FIG. 1C
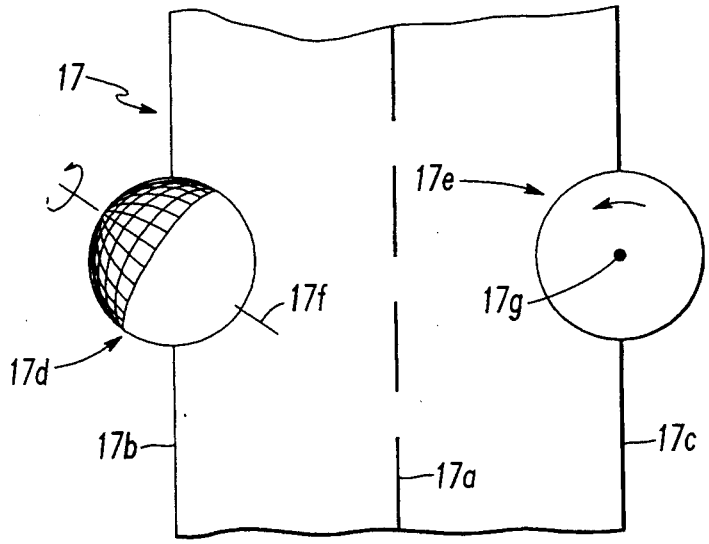
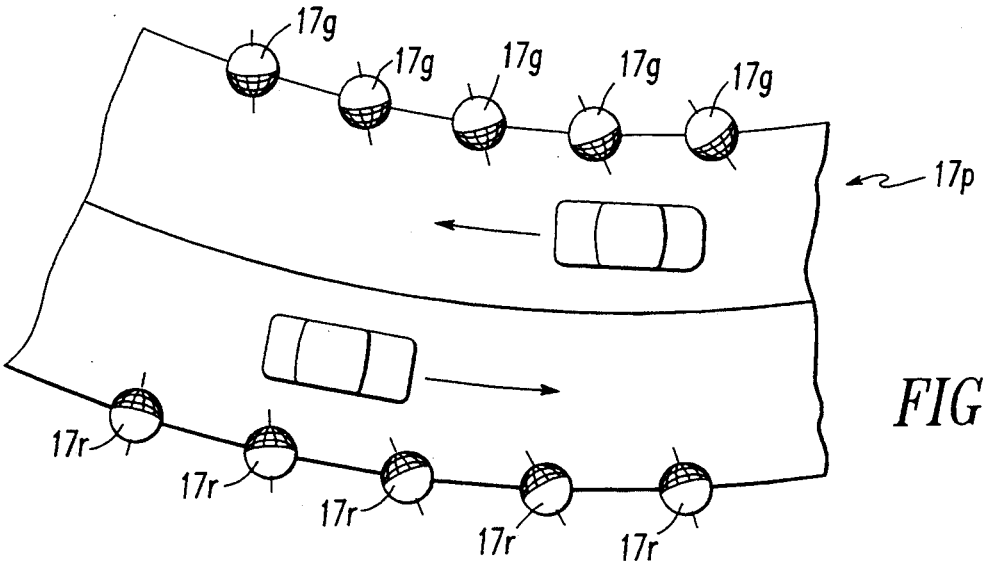
FIG. 1F

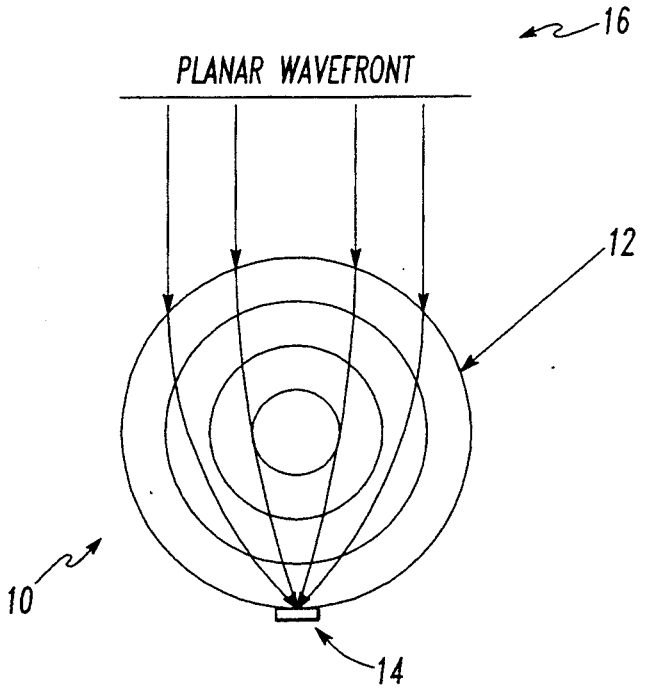
FIG.2
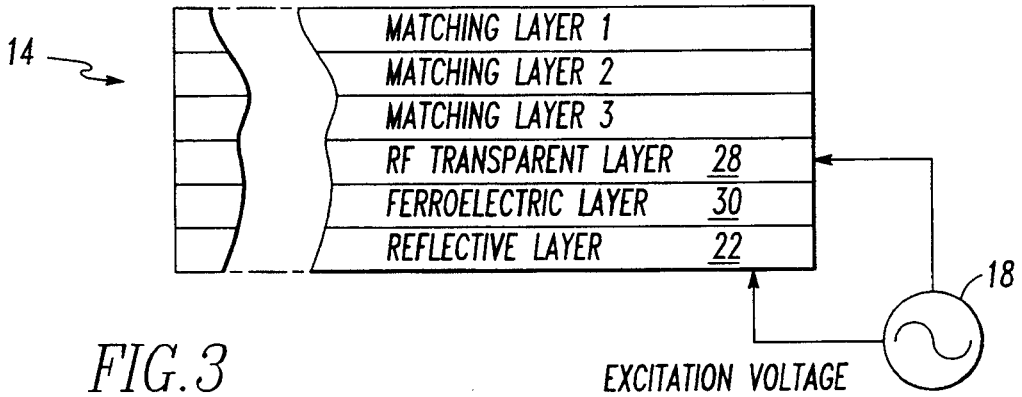
FIG.3
FIG.5
PRIOR ART
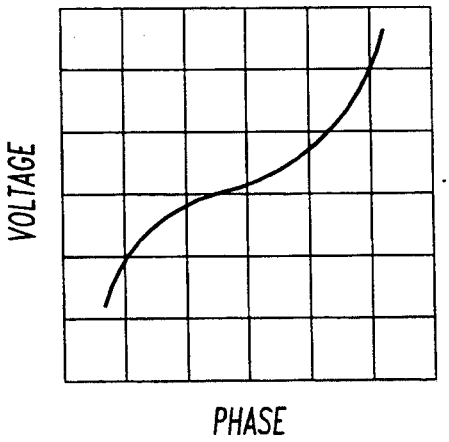

FIG. 9
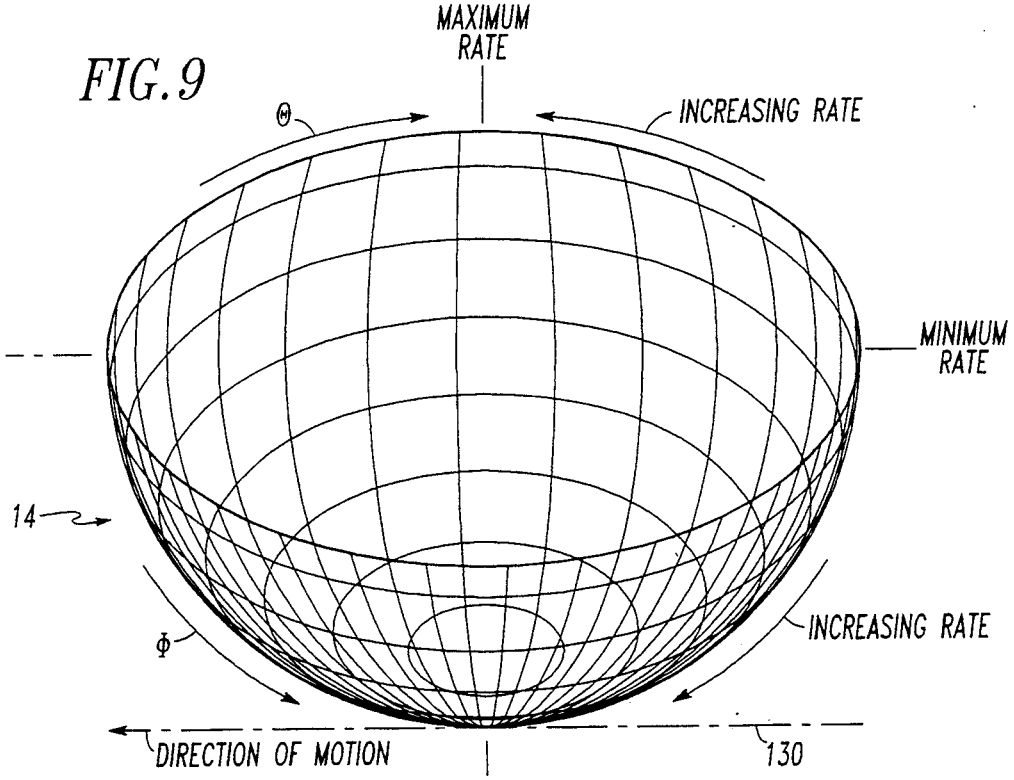
FIG. 10
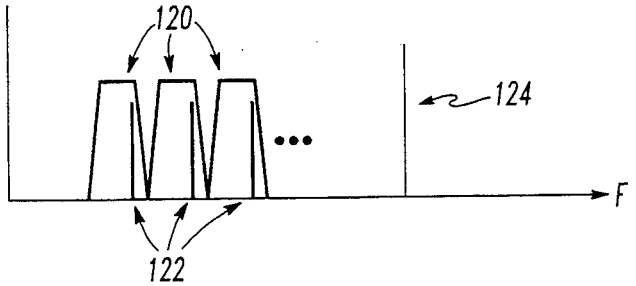
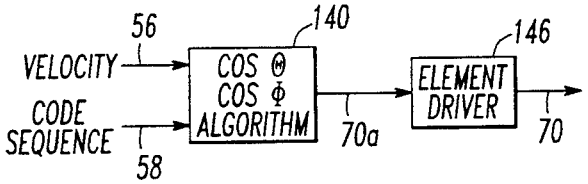
FIG. 11

COMMUNICATIONS RETRO-REFLECTOR

TECHNICAL FIELD

The present invention relates to retro-reflectors and, more particularly, a retro-reflector for communications.

BACKGROUND OF THE INVENTION

A retro-reflector can be used to reflect an incident signal back to the source. A problem with such a retro-reflector is that it has a certain reflectivity that is hard to suppress when it is not being used. This is even harder to do when being used.

Modulators incorporated into retro-reflector systems usually consist of complicated waveguide or RF components built into antenna arrays. Such arrays have been used in the past to give wide area coverage. Units built in an array form have a cost and complexity directly proportional to the array size.

DISCLOSURE OF INVENTION

An object of the present invention is to provide a retro-reflector whose reflectivity can be suppressed.

Another object is to provide a retro-reflector whose reflectivity can be directionally controlled.

Still another object of the present invention is to provide a retro-reflector that can be phase or amplitude modulated in a manner to communicate information.

A further object is to provide a retro-reflector that can provide an identification or information while being rotated.

According to a first aspect of the present invention, a retro-reflector is provided as a combination of a lens and a plurality of mosaic elements covering a predetermined portion of the lens, such as a hemispherical portion of a Luneberg lens.

According further to the first aspect of the present invention, the mosaic elements may differ from each other, having differing reflective and transmissive properties and be arranged in a pattern of such differing elements having symmetry about an axis of rotation of the lens. When the lens is mounted at the hub of a rotating part of a moving vehicle, an interrogation signal will be reflected back to the source modulated by the pattern.

In accord with a second aspect of the present invention, each of the mosaic elements, whether differing from each other or being the same, may be responsive to a corresponding one of a plurality of control signals having differing magnitudes, phases, or both, indicative of a selected characteristic, each corresponding mosaic element for changing its characteristic in response thereto.

In still further accord with the second aspect of the present invention, such a retro-reflector comprising a lens and a plurality of mosaic elements can be used in a system that further comprises a mosaic element controller that is responsive to an interrogation signal, for determining a direction from which the interrogation signal came and for providing the plurality of control signals in response thereto, wherein one or more of the control signals have their magnitudes or phases selected to control the selected characteristic so as to reflect the interrogation signal back in the determined direction from which the interrogation signal came in a controlled manner or to absorb it.

According to a third aspect of the present invention, the interrogation signal includes identification information and wherein the controller is responsive thereto for comparing the identification information in the interrogation signal with prestored identification signals for providing a validation signal, wherein the one or more control signals have their magnitudes or phases selected to control the selected characteristic only in the presence of the validation signal.

In still further accord with the third aspect of the present invention, all but the one or more of the control signals have their magnitudes or phases selected to control the selected characteristic so as to absorb, or modulate in a selected manner, any incoming interrogation signals that are not validated.

According further to the third aspect of the present invention, the one or more of the control signals have their magnitudes or phases selected additionally to control the selected characteristic in a modulated manner so as to convey information in the reflected interrogation signal, only in response to the validation signal.

In accordance still further to the third aspect of the present invention, all but the one or more of the control signals have their magnitudes or phases selected to control the selected characteristic in a modulated manner so as to convey information in any interrogation signal from a source other than the validated source's direction.

Thus, according to the third aspect of the present invention, an interrogation signal is received having directional and identification information from a source; the direction information is determined for providing a direction signal indicative thereof, and the interrogation signal is focused onto one of a plurality of mosaic elements of a retro-reflector; the identification information from the interrogation signal is determined and, if validated, a recognition signal is provided; in the presence of the recognition signal, the selected one or more of the plurality of mosaic elements is modulated with selected information for passively providing, in the determined direction, a reflected interrogation signal back to the source as a modulated interrogation signal for recognition by the source. The others of the plurality of mosaic elements can be controlled to absorb.

In further accord with this third aspect of the present invention, in the absence of validation by a recognition signal, the selected one or more of the plurality of mosaic elements is controlled to absorb or is modulated with information other than the selected information.

The present invention teaches a passive retro-reflector that can be used totally passively in a rotating application or that can be phase- and/or amplitude-modulated in a manner suitable to communicate information. The information can be used as a means of conveying a message or for identification purposes. Furthermore, the passive retro-reflector of the present invention can be controlled in a manner to suppress reflection. This can be done, for example, in the absence of recognition of an interrogation signal. Or, it can be done at all times for all mosaic elements until a recognized interrogation signal is received. At that time, only one or more mosaic element is made reflective. Moreover, the reflection can be controlled in a directional manner in a simple and cost-effective way by causing the unit to function as a collection of separate mosaic elements. The apparatus and method of the present invention can be used anywhere information is transmitted, whether or not the information is fixed, as in the case of an identification tag, or the information is dynamic in nature, such as a message. Examples of uses may be for a passive identification transponder, airport traffic control, and a smart highway system to identify vehicles for tracking or toll payments.

The problem with the prior art retro-reflector systems having a certain fixed apparent cross-section for making it visible to an interrogator and being difficult to suppress when not in use is overcome by the retro-reflector of the present invention which has the ability to lower its cross-section on command.

The complicated waveguides or RF components built into prior art retro-reflector systems made of antenna arrays are avoided simply by using a plurality of mosaic elements made of a special material that can be controlled as to its characteristics by a control signal. Since such arrays had a cost and complexity directly proportional to the size of the array, and since the retro-reflector of the present invention gives the same wide area coverage with a very simple device, the present invention has potentially very low cost. Moreover, the type of construction disclosed herein allows a very diversified modulation scheme that can be used in various coding techniques particular to the application.

These and other objects, features and advantages of the present invention will become more apparent in light of the following detailed description of a best mode embodiment thereof, as illustrated in the accompanying drawing.

BRIEF DESCRIPTION OF THE DRAWING

FIG. 1 is an illustration of a retro-reflector, according to the present invention.

FIG. 1A shows another retro-reflector, according to the present invention.

FIG. 1B shows a retro-reflector mounted on a rotating part of a vehicle, according to the invention.

FIG. 1C shows a pair of stationary retro-reflectors which are mounted with respect to an airport runway, according to the present invention.

FIG. 1F illustrates yet another embodiment of the present invention, where a plurality of rotating retro-reflectors are mounted in stationary positions along the sides of a divided highway for reflecting back interrogation signals from vehicles using the road for indicating to the vehicles their azimuth with respect to the roadway, according to the present invention.

FIG. 2 shows a retro-reflector, according to an embodiment of present invention, but with only one of its mosaic elements illustrated.

FIG. 3 shows the mosaic element of FIG. 2 as embodied in a ferroelectric panel that can be modulated by an excitation voltage source.

FIG. 5 shows phase changes between the incident and reflected waves of FIG. 4 which may be effected using an excitation voltage on the ferroelectric panel of FIG. 4.

FIG. 9 shows a frequency code shift technique as a function of viewing angle, according to the present invention.

FIG. 10 shows a Doppler spectrum of a moving modulator.

FIG. 11 shows an encoding method, according to the present invention, for carrying out the technique illustrated in FIG. 9.

BEST MODE FOR CARRYING OUT THE INVENTION

Figure 1D:
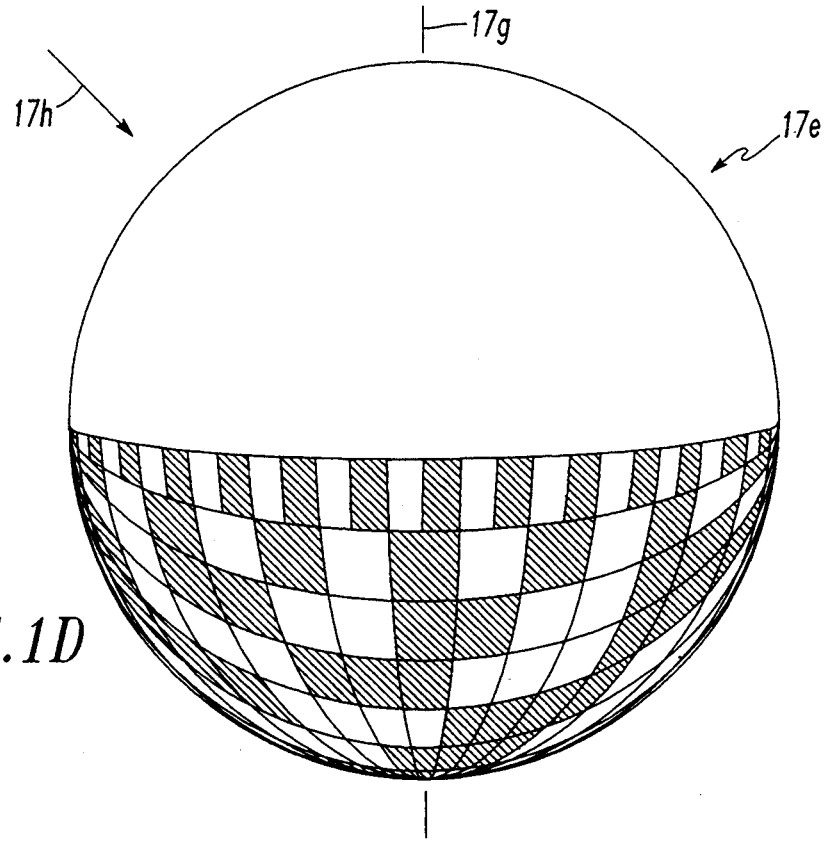
FIG. 1D shows one of the retro-reflectors of FIG. 1C for rotating about a vertical axis, according to the present invention, for reflecting back information in response to an interrogation signal from a landing aircraft, the reflected-back information being indicative of the altitude of the landing aircraft.

FIG. 1 shows a retro-reflector 10, according to the present invention, having a lens 12, such as a Luneberg lens, or other antenna combined with a shutter system which may be a plurality of reflector elements 14 that are separately controllable as to their reflectivity. The reflector elements 14 are formed into a mosaic covering a predetermined portion of the lens such as a hemispherical portion of a Luneberg lens, as shown. Luneberg lenses are known, for example, from section 14-10 of "Antennas" second edition, by John D. Kraus as published by McGraw Hill Book Company. The Luneberg lens is formed of a low-loss dielectric with index of refraction which varies as a function of radius wherein a plane wave incident on one side is brought to a focus on the opposite side. A reflector placed at this focal point will reflect back the source along exactly the same lines as the incoming wave. Practical three-dimensional Luneberg lens are constructed of a large number of spherical shells, like an onion, each shell of constant index of refraction. Discrete changes in index of refraction approximate a continuous variation. An example would be a sphere with an index that starts at approximately $n=1.0$ at the outer surface and increases to $n=\sqrt{2}$ at the center. See, for example, the Model C Radar Target or the Model L Luneberg Lens Microwave device in Technical Bulletins 510 and 530, respectively of the Cuming Corporation of 230 Bodwell Street, Avon, Mass. 02322, U.S.A. The Luneberg lens principle has been applied in the prior art as a passive reflector. A unitary reflecting cap has been placed over a portion of the spherical lens and incident waves from any direction emerge in the same direction from which it entered. Caps have been known to cover a sector as large as a hemisphere. A passive reflector covering two-thirds of a hemisphere is shown in U.S. Pat. No. 4,090,198, for example.

On the other hand, the lens may be of any other suitable type, such as a constant dielectric lens, such as a homogeneous dielectric sphere that may be scanned through $4\pi$ solid radians if the index of refraction is not too high, and if the diameter is not greater than about $30\lambda$. The type of lens selected may be round or spherical, elliptical, semi-elliptical, ellipsoidal, semi-ellipsoidal, or the like. Reference is made to "Introduction to Radar Systems" by Merrill I. Skolnik, McGraw-Hill Book Co., 1962, at pp. 293–294, and also to the Second Edition thereof at pp. 252–254, for a description of various lenses. Also, reference is made to an article entitled "A Homogeneous Dielectric Sphere as a Microwave Lens", by Bekefi et al, *Can. J. Phys.*, Vol. 34, pp. 790–803, August 1956.

The lens and reflectors may both be wideband so that the entire system may be able to work over octaves or even decades of frequencies—from microwave up to millimeter bands.

The approach taken in the embodiment of FIG. 1, for example, is to cover a portion of a Luneberg lens, such as an entire hemisphere, with a reflector but to make it of individually controllable reflector elements 14. Such elements could be made of many different controllable materials such as lightweight, polymer coatings that can absorb signals or change absorption and reflectivity characteristics under the control of an external signal. Such polymers have been specially altered to conduct electromagnetic energy. One combination is a polyaniline base impregnated with cyanate whiskers. The whiskers break up incoming signals and absorb them. When stimulated with control signals the material can alternate light and dark or produce different absorption and reflectivity characteristics. Conducting plastics are reported by Dr. The Kuan et al in *Aerospace Composite Materials* 1 (3): 31–34, Spring, 1989. The reflector elements 14 of FIG. 1 may also comprise ferroelectric elements such as shown in U.S. Pat. No. 4,987,418, for another example.

FIG. 1A shows a retro-reflector 10*a* that is made of a combination of a lens 12*a* and a plurality of mosaic elements. Unlike FIG. 1, the mosaic elements of FIG. 1A may be fixed in transmissive and reflective properties, i.e., not separately controllable, but selected to have a fixed characteristic. Such a mosaic may be laid out in a pattern having symmetry about an axis 15 of rotation of the retro-reflector 10*a*. FIG. 1A shows several different types of mosaic elements arranged in such a pattern. For example, a first type of reflector element 14*a* is shown with horizontal markings arranged symmetrically with respect to the axis of rotation 15. Another type of reflector element 14*b* is shown with vertical markings. Another type of mosaic element 14*c* is shown in three different locations, all having the same type of symmetry as the others. Other types of mosaic elements 14*d*, 14*e* are also shown interspersed with the others at various points to complete the pattern which, of course, will be continued around the entire periphery of the lens 12*a*, which may be a Luneberg lens or any of the other types of lenses previously discussed, and made of a low-loss dielectric. FIG. 1B shows the retro-reflector 10*a* of FIG. 1A mounted on a rotating element 16*a* of a vehicle. An interrogator 16*b* provides an interrogation signal 16*c* which is reflected off a sequence of the rotating reflector elements at a given "latitude" of the retro-reflector, depending on the altitude of the interrogator. If the duration of the interrogation signal on the line 16*c* is longer than the time period it takes for a number of the reflector elements to rotate through a given angle, then the given pattern of the mosaic elements will be reflected back according to the reflective and transmissive properties of the individual mosaic elements that reflect the interrogation signal back to the interrogator, which includes a decoder, on a signal line 16*d*.

FIG. 1C shows an airport runway 17 having a center line 17*a* and shoulders 17*b*, 17*c*. According to the present invention, a pair of stationary, rotating retro-reflectors 17*d*, 17*e* are mounted for rotation at selected points with respect to the runway 17. For example, the retro-reflector 17*d* may be mounted as shown with respect to the shoulders 17*b* for rotation about an axis 17*f* that is oriented at 45° with respect to the shoulder 17*b*, as shown, with a horizontal orientation, i.e., parallel to the runway's surface. Similarly, the retro-reflector 17*e* may be mounted as shown with respect to the shoulder 17*c* and having an axis of rotation 17*g* that is vertical, i.e., perpendicular to the runway surface. The retro-reflector 17*e* is shown in more detail in FIG. 1D with its mosaic elements at the bottom, i.e., closer to the runway and coded in a selected way such as shown with coded information associated with each successive ring of mosaic elements. In the example shown, the successive rings start at the equator with a relatively high frequency variation, which becomes of successively lower frequency as the latitude rings progress toward the bottom. An interrogation signal 17*h* directed from the landing aircraft to the airport will be returned by the retro-reflector 17*e* with coded information from one of the rings that will have a frequency dependent on which ring becomes the reflecting ring. This information may be used by the aircraft to determine its altitude. Of course, it will be realized that the direction of frequency variation could be reversed. It should also be realized that other types of coding schemes could be used besides frequency variations in the mosaic elements, with the same result, of providing altitude information in the reflected signal.

Figure 1E:
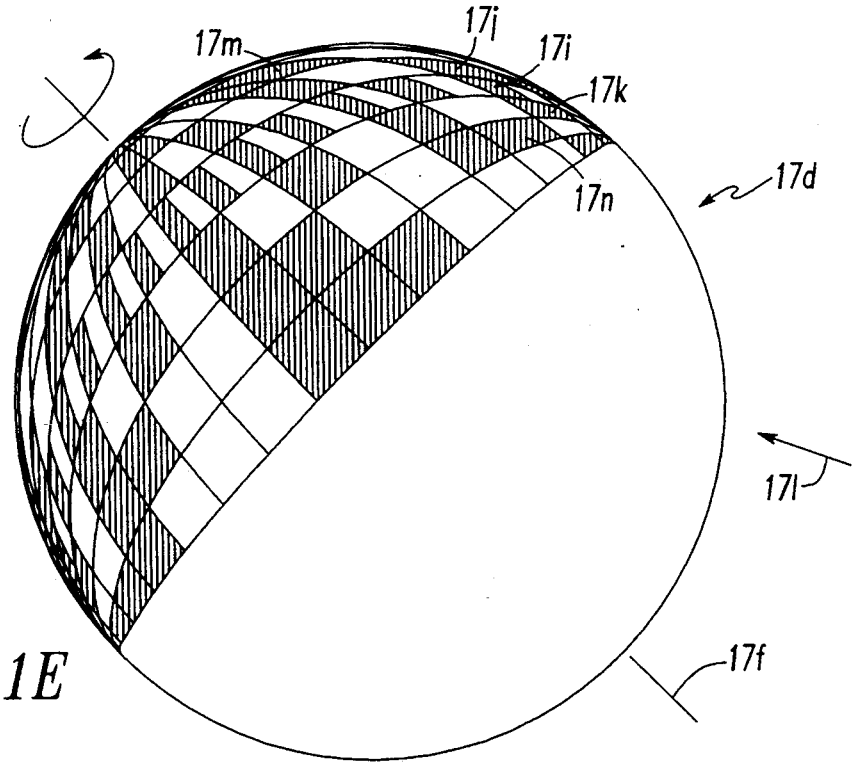
FIG. 1E illustrates the other rotating retro-reflector of FIG. 1C, according to the present invention, for reflecting back an interrogation signal in such a way as to indicate azimuth of the landing aircraft with respect to the runway in such a way that the aircraft can center itself down the middle of the runway.

FIG. 1E shows the retro-reflector 17*d* of FIG. 1C in more detail to illustrate yet another coding scheme which may be used by the landing aircraft to determine its azimuth. In this case, frequency variations are also used for the different rings, but in a slightly different way. As shown, in about the middle ring of the mosaic element hemisphere, a series of mosaic elements 17*i* are alternated with a coding scheme of relatively high frequency compared to mosaic elements 17*j*, 17*k* forming rings on either side thereof and which will reflect an incoming interrogation signal 171 at a frequency lower than that which would be reflected by the ring of elements 17*i*. Similarly, in rings made of elements 17*m*, 17*n* that progress even further away from the ring formed of the elements 17*i*, the frequency becomes even lower. This same pattern is repeated until reaching the equator in one direction and the pole in the other direction until minimum frequency rings are reached. The information reflected from this retro-reflector 17*d* will indicate to the landing aircraft whether or not it is centered on the runway 17. The pilot will use the information to seek a high-frequency retro-reflected signal, regardless of which side of the runway he is approaching from. This will ensure a correct azimuth of the landing aircraft with respect to the runway 17.

In FIG. 1F, a highway 17*p* is illustrated with a plurality of retro-reflectors 17*q* on one side of the highway and 17*r* on the other side. These may be used in a manner similar to the retro-reflector 17*d* of FIG. 1C to reflect back interrogation signals from vehicles on respective sides of the highway for indicating to the vehicles their azimuth with respect to the highway.

It will, of course, be evident that numerous other coding schemes could be used in many other similar applications of the retro-reflector of the present invention. They may be used in stationary applications or on vehicles. They may have any selected orientation. They may be passive in the sense of not being controlled, or may be controllable, as described in more detail below in connection with individually-controllable mosaic elements. The physically-rotated retro-reflectors can be made totally passive without any control of the individual mosaic elements. Or, the retro-reflector may be made stationary and the mosaic elements made to "rotate" under the control of various control signals for controlling the individual elements. Or, the retro-reflector can be made to rotate and have the individual elements controlled as well. The individual mosaic elements may be controlled in any fashion deemed suitable to convey information between the interrogating source and the retro-reflector.

FIG. 2 shows an example of a discretely layered Luneberg lens used for the lens 12 of FIG. 1 in cross-section. A planar wavefront 16, which may be a radar interrogating signal, for example, is shown incident on the Luneberg lens 12 which focuses the wavefront on a particular one of the individual reflector elements 14 of FIG. 1. The purpose of the element 14, as well as all of the other elements integrated into the shutter system such as shown in FIG. 1, is to absorb or scatter incident radiation into or in the lens for the purpose of changing the cross-section as it appears to interrogating signals such as the planar wavefront 16. The incident radiation 16 directed on to the reflector 14 is directed back to the interrogating source depending on the excitation or lack thereof provided to the reflector element as described in connection with FIG. 3.

Figure 4:
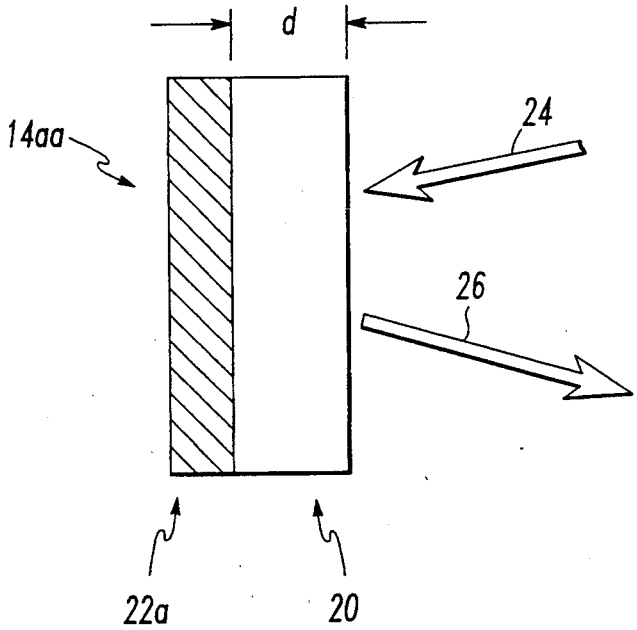
FIG. 4 PRIOR ART
FIG. 4 shows the theory of a ferroelectric panel, according to the prior art.

As shown in the example of FIG. 3, the element 14 of FIG. 2 is illustrated in cross-section, being of the type described in the above cited U.S. Pat. No. 4,987,418, i.e., of the ferroelectric panel type that can be excited by an excitation voltage 18 in order to have its dielectric changed. As shown in the simplified illustration of FIG. 4, for example, a reflector element **14*aa* has a variable permittivity material layer 20 of thickness d backed by a reflector 22*a* which reflects an incident wave 24 as a reflected wave 26 having a phase difference with the incident wave 24 that is proportional to a change in permittivity multiplied by twice the path length d. This is shown in FIG. 5. Referring back to FIG. 3, a similar reflective backing layer 22 is shown connected to one side of the excitation voltage 18 while the other side of the excitation voltage source 18 is applied to an RF transparent layer 28 so that a ferroelectric layer 30, in between the reflective layer 22 and the RF transparent layer 28, may have its permittivity changed according to changes in the excitation voltage source 18. As shown, for example, in FIG. 5, the phase of the reflected planar wavefront 16 of FIG. 2 will change as a result according to changes in the voltage source 18**.

It should be realized that the element 14 of FIG. 1 can be configured to operate in more than one configuration. For example, the element 14 can be configured as shown in FIG. 3 and placed as shown in FIG. 2 at the focal point on the lens and used as a modulator. The modulator can be used to modulate the amplitude, phase, or both, of the reflected signal. For the case of amplitude modulation, the amplitude change seen in the reflected signal by the interrogating system will be the difference in cross-section with the lens and quality of the reflective surface as compared to the quality of the shutter to pass incident radiation and have it absorbed by the absorber material.

Figure 6:
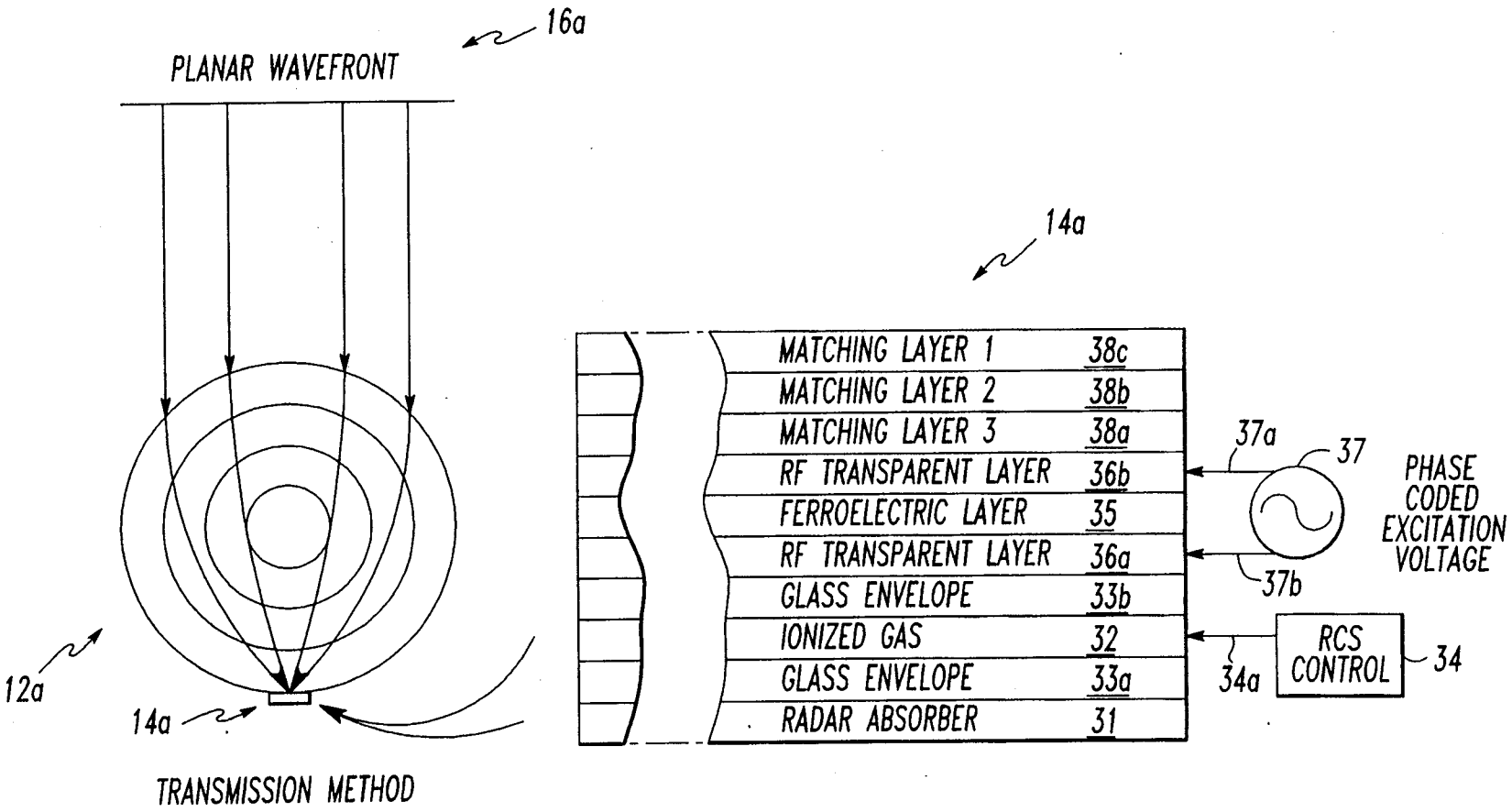
FIG. 6 shows a second exemplary configuration for a retro-reflector element using both phase and amplitude modulation.

In other configurations, the elements can be configured differently, with selected layers placed outside of the focal point such and can be used to allow incident radiation to enter the lens or to be scattered from the layer's controlled reflective characteristic. For example, as shown in FIG. 6, a planar wavefront **16*a* is focused by a spherical lens 12*a* onto one mosaic element 14*a* of a plurality of such elements forming a mosaic such as shown in FIG. 1 at the various focal points of the Luneberg lens. A cross-section of the mosaic element 14*a* is also shown in FIG. 6. It is intended for use in a radar application where a bottommost layer 31 comprises a radar absorber material upon which a gas layer 32 is placed, surrounded by a pair of glass envelope layers 33*a*, 33*b*. A radar cross-section (RCS) control 34 controls the gas layer by ionizing the gas layer with a control signal on a line 34*a*. Next, a ferroelectric layer 35 is surrounded by a pair of RF transparent layers 36*a*, 36*b*. The ferroelectric layer has its dielectric changed by a phase-coded excitation voltage source 37 that applies control signals on lines 37*a*, 37*b* to the RF transparent layers 36*a*, 36*b*. Effectively, this provides the phase-coded excitation voltage to either side of the ferroelectric layer 35** in order to change its dielectric according to the phase-coded excitation voltage, which may be a time-varying excitation voltage of any selected form, not necessarily periodic, or which may be coded in analog or digital form with selected information.

A plurality of matching layers **38*a*, 38*b*, 38*c* are shown and are used for the purpose of matching the low-loss dielectric of the spherical lens 12*a* to the reflector element 14*a***, i.e., so as to prevent excessive reflection at the interface.

After passing through the matching layers **38*c*, 38*b*, 38*a*, the planar wavefront 16*a* passes through the RF transparent layer 36*b*, the ferroelectric layer 35 and the RF transparent layer 36*a*. The phase-coded excitation voltage source 37 can provide the control signals on the lines 37*a*, 37*b* in order to change the dielectric characteristic of the ferroelectric layer in order to change the phase of the wavefront 16*a*, according to the control signals 37*a*, 37*b*. Of course, such phase modulation is optional and can be omitted for some or all incoming incident wavefronts. After phase modulation, the incoming wavefront 16*a* may be amplitude-modulated by the RCS control 34. With more or less ionization of the gas layer 32 by the control signal 34*a*, reflection can be more or less correspondingly controlled. For example, with full ionization, the incoming wavefront 16*a* can be reflected back to the source with a high degree of reflectivity. Without ionization, the wavefront 16*a* can be allowed to pass through the gas layer 32 and be absorbed by the absorber layer 31. In that case, a very low degree of reflectivity exists, and substantially none of the wavefront 16*a* is reflected back. In between these two extremes, the RCS control 34 can control intermediate levels of ionization of the gas layer 32 in order to amplitude-modulate the reflected planar wavefront 16*a*. In this way, both phase and amplitude modulation can be combined to increase the versatility of the passive retro-reflector. It should be realized that the materials illustrated need not be confined to just those materials. For example, the ionized gas layer 32 with its surrounding glass envelope layers 33*a*, 33*b* and the radar absorber layer 31** can all be replaced by a special plastic, such as the above-described polymer coatings that have been specially altered to conduct electromagnetic energy.

Figure 7:
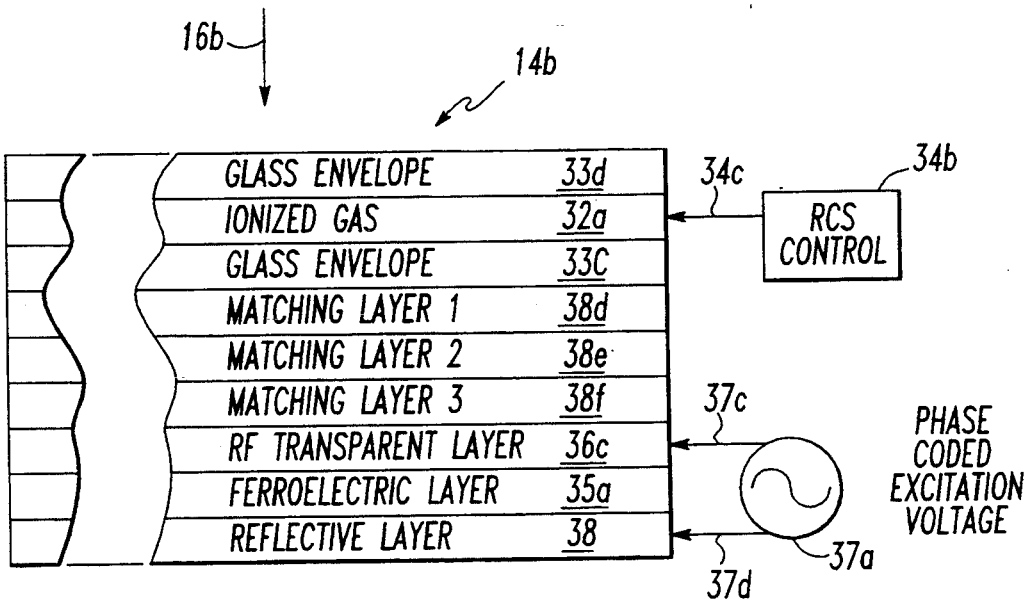
FIG. 7 shows yet another exemplary retro-reflector element using amplitude and phase modulation.

Another example of a reflector element 14*b* is shown in FIG. 7 with an individual RCS control 34*b* providing a control signal 34*c* to an ionized gas layer 32*a* surrounded by glass envelope layers 33*c*, 33*d*, similar to that described in FIG. 6, except being first responsive to an incoming wavefront 16*b*. The layers 32*a*, 33*c*, 33*d* may be positioned at a non-focal point of an associated spherical lens so as to be in a position to scatter all of the incoming wavefront before it can become focused. Such would be utilized if it is desired to prevent reflection back to the interrogation source. In that particular case of an interrogation signal that is not to be reflected back, a phase-coded excitation voltage source 37*a* would not be energized in any particular way. On the other hand, if the RCS control signal on the line 34*c* is controlled for another interrogation signal in such a way as to permit the incoming wavefront 16*b* to pass through the ionized gas layer and its surrounding glass envelopes and furthermore, to pass through a plurality of matching layers 38*d*, 38*e*, 38*f*, then the phase-coded excitation voltage source 37*a* can be used to provide control signals on the lines 37*c*, 37*d* to control the dielectric constant of a ferroelectric layer 35*a* so as to change the phase of the incoming wavefront 16*b* before it is reflected back by a reflective layer 38. As before, the RCS control 34*b* and the phase-coded excitation voltage source 37*a* can be used together to provide both amplitude and phase modulation, respectively. As will be evident by the examples given in FIGS. 2, 6 and 7, various combinations of such layers can result in many variations of the retro-reflector elements according to the teachings of the present invention.

Figure 8:
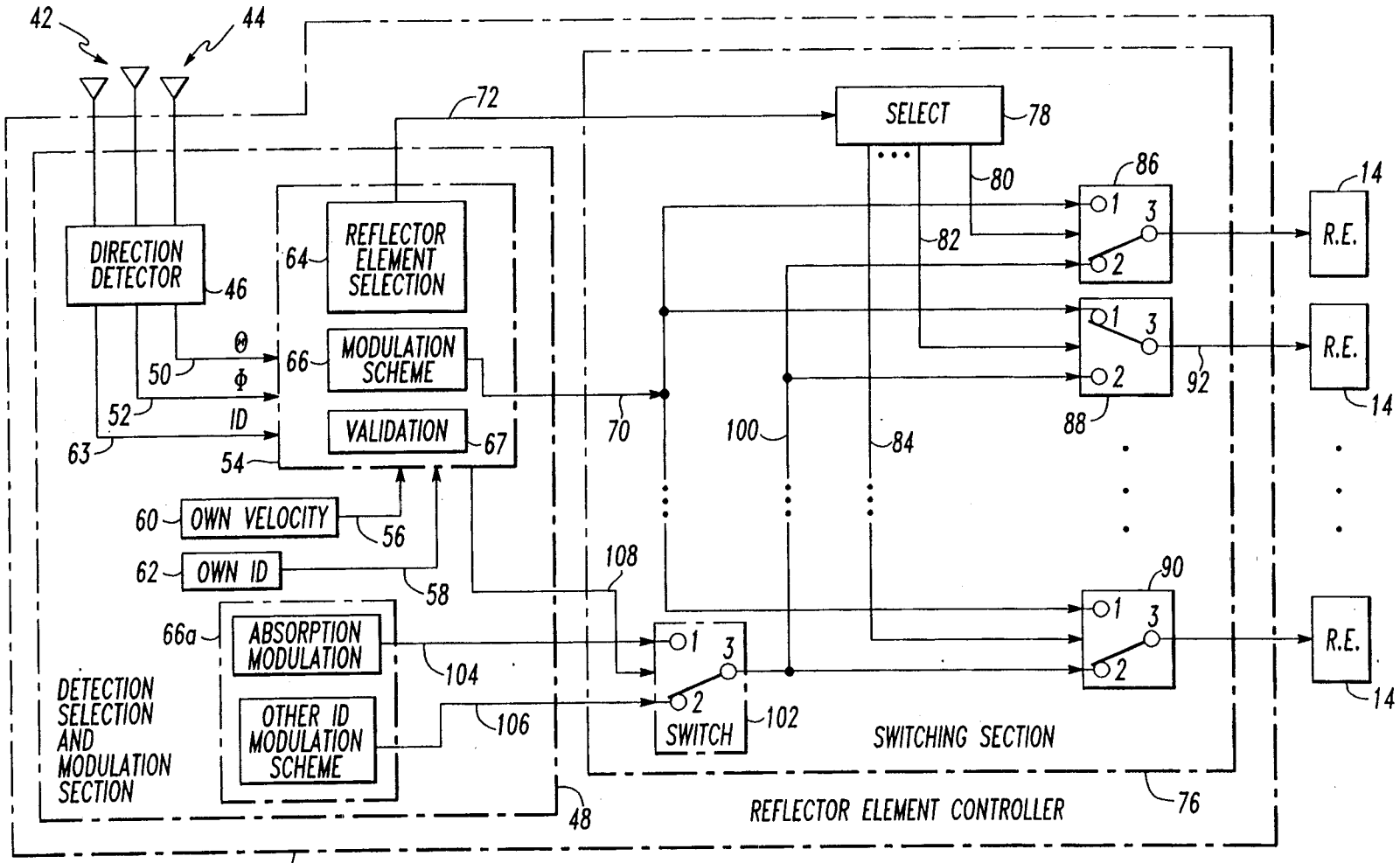
FIG. 8 shows a reflector element controller that may be used to select one of the reflector elements of FIG. 1 to be selected in accordance with the detected direction of an interrogation source for modulation.

According further to the teachings of the present invention, each of the elements 14 in FIG. 1 is separately controllable by one or more excitation control signal sources. Each can be hooked up to a separate excitation control signal source or one or more excitation voltage sources can be shared by all of the reflector elements or by subsets thereof by the use of switching techniques to be described below, for example, as shown in FIG. 8. There, a reflector element controller 40 is shown being responsive to an incoming signal 42 from, for example, an interrogating source such as an aircraft. One or more directional antennas 44 sense the incoming signal 42 and a direction detector 46 within a detection, selection and modulation section 48 detects the direction of the interrogating source with respect to the antenna array 44 (such as by known triangulation methods) and provides one or more output signals on lines 50, 52, for example, which may be signals indicative of the direction of the interrogating source in angular polar coordinates ($\theta$, $\phi$). A signal processor 54 may include a microprocessor, a random access memory, a read only memory, input-output ports and the like for processing the polar coordinate signals on the lines 50, 52 and additional input signals on lines 56, 58 from a velocity indicator or sensor 60 and a self-identification generator 62, respectively.

The detector 46 may also extract identification information from the interrogation signal 42 for providing an interrogator identification signal on a line 63 to the signal processor 54. This information would identify the interrogation source to the reflector element controller which identification may be validated within the signal processor 54.

The signal processor 54 may carry out tasks that may broadly be characterized in three major groupings comprising reflector element selection 64, control of modulation 66 and validation 67. The validation function is for the purpose of comparing the content of the identification signal on the line 63 with information stored within a memory within the signal processor 54. Upon validation or not, the nature of the desired modulation or lack thereof is determined. The control of modulation 66 is for the purpose of controlling, by means of a modulation signal 70, one of the reflector elements 14 that is selected by a selection signal on the line 72, also provided by the signal processor 54, as illustrated by the reflector element selection block 64. The selection signal on the line 72 is provided to a switching section 76 which includes a select block 78 that is responsive thereto for providing a selection signal on one of a plurality of selection signal lines 80, 82, . . . , 84 to a corresponding one of a plurality of switches 86, 88, . . . , 90. Each of the switches 86, 88, . . . , 90 is shown, for purposes of simplicity, as a double-throw switch. The switch 88 is shown in a position different from the switches 86, 90, indicating that the signal on the line 82 has been chosen by the select control 78 to be the selection signal. This means that the modulation signal on the line 70 is provided on a line 92 to a particular one of the reflector elements 14. The other reflector elements do not receive the modulation signal on the line 70 since they are all connected to another pole (2) of their respective switches 86, . . . , 90. These may in turn be connected to a signal line 100 from a switch 102 that can be connected to other modulation control signals on lines 104, 106, for example. The signal on the line 104 is effective to cause a condition in which all reflector elements to which it is connected to be rendered completely absorptive to incident radiation or substantially so. In the alternative, other modulation schemes may be used to modulate the other reflective elements such as by another modulation scheme signal on the line 106. All of these different techniques are illustrated in a functional block 66*a* which can also be carried out by the signal. processor 54. In that case, a control signal on a line 108 from the processor 54 can be used to control the switch 102. Of course, all of these functions can be carried out in software and are illustrated in simplified functional blocks for the purposes of illustrating the overall functions.

It should be realized that the retro-reflector 10 of FIG. 1 in combination with the controller 40 of FIG. 8 can also be used in a context similar to that already described in connection with FIGS. 1A and 1B. In other words, the retro-reflector of FIG. 1 can be mounted on a rotating part of a vehicle and the controller 40 be used the control the individual mosaic elements in a pattern similar to that shown in connection with FIG. 1A, except using controllable elements rather than totally passive elements. In that case, the information rate previously achievable using the approach of FIG. 1 and FIG. 8 alone can be improved using the angular velocity of the rotating member.

Referring now to FIG. 9, the bottom hemisphere of the device 10 of FIG. 1 is illustrated in a "wire-frame" polar coordinate system that can be the same as that already described for locating the direction of the interrogating source. For cases where the retro-reflector 10 of FIG. 1 is mounted on a moving vehicle, it will be important for certain interrogation techniques for the modulation scheme 66 carried out by the signal processor 54 of FIG. 6 to take into account Doppler effects caused by the motion of the vehicle itself. This because certain types of modulators incorporated into retro-reflector systems utilize identification modulation techniques such as "frequency hopping" that are supposed to produce a reflected frequency spectrum that can be precisely filtered to identify the retro-reflector. Such techniques are susceptible to error due to Doppler effects caused by motion of the interrogated vehicle. The interrogating source can algorithmically take into account its own motion, if any, with regard to the retro-reflector but cannot usually also take into account any motion of the vehicle upon which the retro-reflector is mounted. For example, as shown in FIG. 10, a plurality of filters 120 are designed to be responsive to particular frequency hopped codes 122 that are illustrated being reflected back and received off-center on account of a vehicle Doppler effect 124 imposed on the spectrum on account of the motion of the vehicle with respect to the interrogating source.

According to the present invention, such can be alleviated by altering the modulation depending on the reflector element 14 selected by the select control 78 of FIG. 6. Each element has a fixed relation to the vehicle that can be taken into account in selecting the corresponding fixed Doppler correction required, in proportion to the velocity of the vehicle. By changing the modulation provided on the line 70 according to the identity of the reflector element and the velocity of the vehicle, Doppler effects can be automatically corrected for. As shown in FIG. 9, a direction of motion 130 is shown with respect to the array of reflector elements 14 formed in a hemisphere as in FIG. 1. For any given reflector element at angles $\Theta$, $\phi$, if any interrogation source is oriented at a particular position so as to be aligned with the element, it will always have the same relative increasing or decreasing Doppler rates, depending only on the magnitude of the vehicle's velocity. By taking these increasing and decreasing rates into account in a selected algorithm, the Doppler effects can be cancelled and the reflected spectrum properly positioned within the centers of the frequency passbands. As illustrated in FIG. 11, for example, a rate corrective algorithm 140 is responsive to a velocity signal on the line 56 and the identification signal on the line 58 (see FIG. 8) for providing a modulation control signal on a line 70*a* to an element driver 146 for providing the modulation control signal on the line 70 of FIG. 8.

Figure 12:
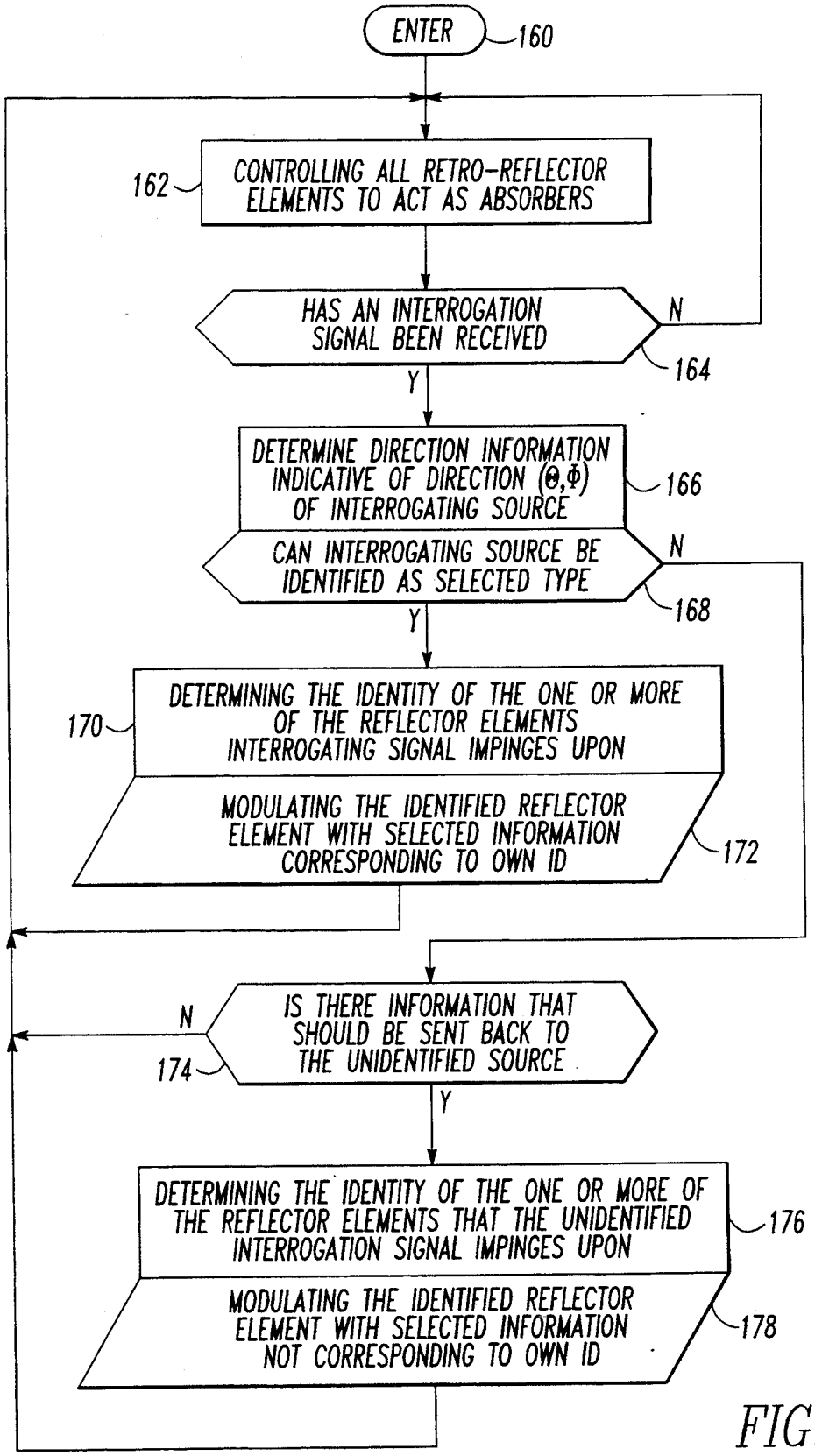
FIG. 12 shows a series of steps which may be carried out in the controller of FIG. 8.

FIG. 12 shows a simplified flow chart illustrating steps that may be carried out by the signal processor 54 of FIG. 8. After entering in a step 160, a step 162 may be executed to control all of the retro-reflector elements 14 of FIGS. 1 and 8 to act as absorbers. This reduces the reflectance cross-section from the perspective of interrogating sources. A step 164 next determines whether an interrogation signal has been received. If not, the step 162 continues to be executed to control all of the retro-reflectors as absorbers. Once an interrogation signal is detected in the step 164, a determination is made in a step 166 of the direction information indicative of the direction of the interrogating source, for example, as carried out by the direction detector 46 of FIG. 6 instead of the signal processor 54. The signals on the line 50, 52 are provided to the signal processor 54 in order to indicate the direction of the interrogating source in polar coordinates, as explained previously. A step 168 is next carried out, for example, by the validation block 67 of FIG. 6 which determines whether or not the information extracted from the interrogation signal 42 and as provided on the line 63 to the signal processor 54 can be identified or validated as of a selected type of interrogation signal. If so, the signal processor 54 carries out the reflector element selection function 64 of FIG. 6 and determines the identity of the one or more of the reflector elements 14 that the interrogation signal 42 impinges upon, as indicated in a step 170. The self-identification information on the line 58 may then be used by the modulation function 66 to modulate the identified reflector element with selected information corresponding to its own type or unique identification information, as indicated in a step 172. A return is then made to controlling all retro-reflector elements to act as absorbers that is indicated in the step 162.

If it were determined in the step 168 that the interrogating source could not be identified or validated as to a selected type, a step 174 may then be executed instead of the steps 170, 172. It should be understood that the interrogating source could nonetheless have been identified as belonging to some other type that is not validated but to which an appropriate different type of response could or should be made. In that case, a determination is made in the step 174 as to whether or not information should be sent back to the unidentified or unvalidated source. If not, the step 162 is simply carried out to cause all retro-reflector elements to act as absorbers, as before. If, on the other hand, it is determined that selected information, such as deceptive information, should be sent back to the unidentified source, a step 176 is executed to determine the identity of the one or more of the reflector elements that the unidentified interrogation or unvalidated signal impinges upon. A step 178 is next carried out to modulate the identified reflector element with the selected information that does not correspond to the reflector's own identification.

It should be realized that the modulating steps 172, 178 can include substeps of modulating the identified reflector element to correct for Doppler effects as explained in connection with FIGS. 7–9, using an appropriate algorithm 140, as explained previously.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

I claim:

1. A method, comprising the steps of:

receiving an interrogation signal having directional and identification information from a source;

determining the direction information for providing a direction signal indicative thereof;

determining the identification information for providing a recognition signal;

in the presence of the recognition signal, reflecting the interrogation signal from a selected one of a plurality of reflector elements in a mosaic on a lens.

2. The method of claim 1, further comprising the step of modulating the selected one of the plurality of reflector elements with selected information for passively providing, in the determined direction, a reflected interrogation signal back to the source as a modulated interrogation signal for recognition by the source.

3. The method of claim 1, further comprising the steps of:

in the absence of the recognition signal, modulating the selected one of the plurality of reflector elements with information other than the selected information.

4. The method of claim 1, further comprising the step of controlling reflector elements other than the selected reflector element to absorb interrogation signals.

5. A retro-reflector, comprising:

a lens; and a plurality of reflector elements formed into a mosaic covering a predetermined portion of the lens, each of the plurality of reflector elements being individually controllable.

6. The retro-reflector of claim 5, wherein each reflector element is responsive to a corresponding one of a plurality of control signals, each reflector element for changing its transmissive or reflective characteristic in response thereto.

7. A retro-reflector, comprising:

a lens;

a plurality of reflector elements formed into a mosaic covering a predetermined portion of the lens, wherein each reflector element is responsive to a corresponding one of a plurality of control signals, each reflector element for changing its transmissive or reflective characteristic in response thereto; and a reflector element controller, responsive to an interrogation signal, for determining a direction and for providing the plurality of control signals wherein one or more of the control signals control the transmissive or reflective characteristic of corresponding reflector elements so as to reflect the interrogation signal back in the determined fashion in a controlled manner.

8. The retro-reflector of claim 7, wherein all but one or more of the control signals control corresponding reflector elements so as to absorb any incoming interrogation signals.

9. The retro-reflector of claim 7, wherein the one or more of the control signals control the transmissive or reflective characteristics in a modulated manner so as to convey information in a reflected interrogation signal.

10. The retro-reflector of claim 8, wherein the one or more of the control signals control the transmissive or reflective characteristics in a modulated manner so as to convey information in a reflected interrogation signal.

11. The retro-reflector of claim 7, wherein all but the one or more of the control signals control the transmissive or reflected characteristics in a modulated manner so as to convey information in any interrogation signal from a source other than the determined direction and reflected by corresponding all but one or more reflector elements of the retro-reflector.

12. The retro-reflector of claim 10, wherein all but one or more of the control signals control the transmissive or reflective characteristics in a modulated manner so as to convey information in any interrogation signal from a source other than the determined direction and reflected by corresponding all but one or more reflector elements of the retro-reflector.

13. The retro-reflector of claim 7, wherein the interrogation signal includes identification information and wherein the controller is responsive thereto for comparing the identification information in the interrogation signal with prestored identification signals for providing a validation signal, wherein the one or more control signals control the transmissive or reflective characteristics only in the presence of the validation signal.

14. The retro-reflector of claim 8, wherein the interrogation signal includes identification information and wherein the controller is responsive thereto for comparing the identification information in the interrogation signal with prestored identification signals for providing a validation signal, wherein the one or more control signals control the transmissive or reflective characteristics only in the presence of the validation signal.

15. The retro-reflector of claim 5, wherein at least a plurality of the reflector elements each comprise:

at least one matching layer;

a ferroelectric layer; and a reflective layer.

16. The retro-reflector of claim 15, further comprising a transparent layer between the at least one matching layer and the ferroelectric layer.

17. The retro-reflector of claim 6, wherein at least a plurality of the reflector elements each comprise:

a first layer or series of layers positioned between an incoming interrogation signal and a focal point of the lens for having its reflective or transmissive characteristic controlled by a first control signal for reflecting the interrogation signal in a scattered manner back to the lens or for transmitting the incoming interrogation signal to the focal point;

a second layer or series of layers positioned at or just before the focal point of the lens, responsive to the interrogation signal, for having its transmissive characteristic controlled by a second control signal for modulating the interrogation signal; and a third, reflective layer, positioned at the focal point, responsive to the interrogation signal from the second layer, for reflecting the interrogation signal back through the second and first layers to the lens.

18. The retro-reflector of claim 17, wherein the first control signal amplitude modulates the interrogation signal.

19. The retro-reflector of claim 17, wherein the second control signal phase modulates the interrogation signal.

20. The retro-reflector of claim 18, wherein the second control signal phase modulates the interrogation signal.

21. The retro-reflector of claim 6, wherein at least a plurality of the reflector elements each comprise:

an absorber layer having an absorptive characteristic for an interrogation signal; and a first controlled layer positioned between the lens and the absorber layer, responsive to a first control signal, for having its transmissive or reflective characteristic controlled, and responsive to an interrogation signal for reflecting or transmitting the interrogation signal according to the controlled reflective characteristic.

22. The retro-reflector of claim 21, further comprising a second controlled layer positioned between the lens and the first controlled layer, responsive to a second control signal, for having its transmissive characteristic controlled, and responsive to the interrogation signal for transmitting the interrogation signal with more or less phase shift, according to the second control signal.

23. The retro-reflector of claim 21, wherein the first controlled layer is located at a focal point of the lens.

24. The retro-reflector of claim 6, further comprising a reflector elements controller for controlling all the reflector elements to absorb all interrogation signals except identified interrogation signals, wherein the controller is responsive to interrogation signals having source identification information therein, for identifying a source and for determining its direction, for providing a control signal for selecting and controlling one or more of the reflector elements for reflecting the interrogation signal back to the source.

25. The retro-reflector of claim 5, wherein the lens is a Luneberg lens.

26. The retro-reflector of claim 5, wherein the lens is a constant dielectric lens.

27. The retro-reflector of claim 5, wherein the lens is an elliptical, semi-elliptical, ellipsoidal or semi-ellipsoidal lens.

28. The retro-reflector of claim 5, wherein the reflector elements have different inherent reflective and transmissive characteristics and are arranged in a pattern for reflecting an interrogation signal with the pattern as the lens rotates about a rotation axis.

29. The retro-reflector of claim 6, wherein the control signals control the reflector elements to have different reflective and transmissive characteristic in a pattern for reflecting an interrogation signal with the pattern as the lens rotates about a rotation axis.

30. A method, comprising the steps of:

(1) controlling all of a plurality of retro-reflector elements of a lens to act as absorbers;

(2) determining if an interrogation signal has been received and, if not, repeating steps (1) and (2) until an interrogation signal is received;

(3) determining a direction from which the interrogation signal has been received;

(4) determining whether an interrogating source can be identified as a selected type and, if not, next executing step (6) and subsequent steps, and if so, next executing step (5) and subsequent steps;

(5) determining which one or more of the reflector elements the interrogation signal impinges upon and controlling the transmissive or reflective characteristics of the so-determined one or more reflector elements for reflecting the interrogation signal back through the Luneberg lens to the interrogating source;

(6) determining whether there is information that should be sent back to a source other than of the selected type or to an unidentified source and, if not, repeating steps (1) and subsequent steps, as before, and if so, determining one or more of the reflector elements that the unidentified interrogation signal impinges upon; and (7) modulating the one or more of the reflector elements that the unidentified interrogation signal impinges upon with selected information.

31. The method of claim 30, wherein step (5) further comprises the step of modulating the reflector element upon which the identified interrogation signal impinges with other selected information.

32. The method of claim 31, wherein the step of modulating is a step of phase modulating.

33. The method of claim 32, further comprising the step of correcting for Doppler shifts according to a velocity signal indicative of a velocity of a vehicle upon which the lens is mounted and according to the one or more of the plurality of retro-reflector elements determined in the step (5).

34. The method of claim 1, further comprising the step of correcting for Doppler shifts in the reflected interrogation signal due to motion of a vehicle upon which the reflector elements are mounted.

* * * * *